US005784921A

United States Patent [19]

Venäläinen

[11] Patent Number: 5,784,921

[45] Date of Patent: Jul. 28, 1998

[54] DEVICE FOR ADJUSTING THE STRAIGHTENING BENCH OF THE CAR BODY STRAIGHTENING AND MEASURING SYSTEM

[75] Inventor: Olavi Venäläinen, Kuopio, Finland

[73] Assignee: Autorobot Finland Oy, Kuopio, Finland

[21] Appl. No.: 715,545

[22] Filed: Sep. 13, 1996

Related U.S. Application Data

[63] Continuation of PCT/FI95/00136, Mar. 14, 1995.

[30] Foreign Application Priority Data

Mar. 14, 1994 [FI] Finland ..... 941191

[51] Int. Cl.[6] ..... B21D 1/12

[52] U.S. Cl. ..... 72/457; 72/705

[58] Field of Search ..... 72/457, 705; 187/203, 187/210, 213, 215; 254/3 B

[56] References Cited

U.S. PATENT DOCUMENTS

| | | | |
|---|---|---|---|
| 4,134,501 | 1/1979 | Tune | 254/3 B |
| 4,506,866 | 3/1985 | Horn | 254/3 B |
| 4,592,225 | 6/1986 | Eck . | |
| 4,848,136 | 7/1989 | Venalainen . | |
| 4,854,151 | 8/1989 | Belgarde . | |
| 4,916,930 | 4/1990 | Belgarde . | |

FOREIGN PATENT DOCUMENTS

| | | |
|---|---|---|
| 53930 | 5/1978 | Finland . |
| 59348 | 4/1981 | Finland . |
| 2 177 547 | 11/1973 | France . |
| 2 155 737 | 5/1973 | Germany . |
| 132424 | 8/1975 | Norway . |
| 87 07191 | 12/1987 | WIPO . |

*Primary Examiner*—Lowell A. Larson
*Attorney, Agent, or Firm*—Cushman Darby & Cushman IP Group of Pillsbury Madison & Sutro LLP

[57] ABSTRACT

The invention relates to a device for adjusting the inclination of the straightening bench of the car body straightening and measuring system which consists of a support (1) having the construction allowing moving heightwise, a straightening bench (2) attached to the support which the vehicle (3) is arranged to be mounted on and a cylinder (4) in order to transfer the support and the straightening bench vertically. For adjusting the inclination of the straightening bench the device includes a cylinder (6) attached at one end (5) to the straightening bench.

2 Claims, 3 Drawing Sheets

DEVICE FOR ADJUSTING THE STRAIGHTENING BENCH OF THE CAR BODY STRAIGHTENING AND MEASURING SYSTEM

This is a Continuation of: International Appln. No. PCT/F195/00136 filed Mar. 14, 1995 which designated the U.S.

BACKGROUND OF THE INVENTION

The present invention relates to a device for adjusting a straightening bench of a car body straightening and measuring system, which includes a support which is transferable vertically, a straightening bench attached to the support on which the vehicle is mounted, and a cylinder for vertical transfer of the support and the straightening bench.

When damaged vehicles are repaired with the help of a straightening and measuring system, they are firstly placed on the car body straightening and measuring system and attached thereto with sill clamps. The vehicle is then lifted to the desired height and, with the help of the straightening system, the damaged areas are pulled in order to straighten the car body. There is a problem in present systems in that the inclination of the straightening bench cannot be adjusted after the vehicle has been mounted and lifted on the straightening bench. In present systems the straightening bench can be in an inclined position only when the vehicle is driven or transferred onto the straightening bench, but then it is turned into a horizontal position and a positioning locking is made mechanically. There is also a problem that the vehicle often is in such a position that the clamps cannot be immediately attached on the vehicle, but the place position for them must be located later by initially placing the clamps at different points. Additionally there is a problem that the vehicle is in the horizontal position during the whole repair preventing the effective handling from all the sides.

SUMMARY OF THE INVENTION

It is an object of the present invention to provide a device for simply and accurately adjusting the inclination of the straightening bench. Furthermore, it is an object of the invention to provide device which simplifies a vehicle straightening procedure.

The goal set for the invention is achieved through the device which is characterized by what is stated in the appended claims.

According to the invention, the device includes a cylinder attached at one end of the straightening bench in order to adjust the inclination. With the help of the cylinder the straightening bench can be turned to the different angles while the straightening bench is positioned in different heights. The device is simple and its operation easy and accurate.

In one preferred embodiment of the invention one end of the cylinder is attached to the support. The cylinder moves with the support and is easily accessible.

In the other preferred embodiment of the invention, one end is attached to a slider, which is fixed to the straightening bench using a construction allowing it to move lengthwise. Additionally a support arm is attached to both the slider and the support. Then the cylinder is attached to the straightening bench, but through the support arm is also attached to the support. The operation of the a device is easy and simple.

BRIEF DESCRIPTION OF THE DRAWINGS

The invention is explained more accurately referring to the attached drawings where.

Figure 1:
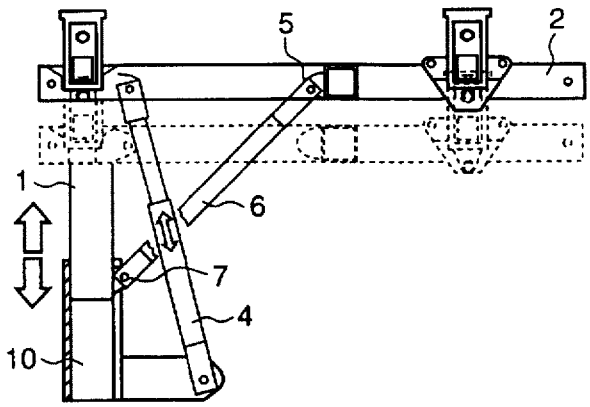
FIG. 1 shows an embodiment of the device according to the invention included as a part of a car body straightening system while the straightening bench is in different heights.
Figure 2:
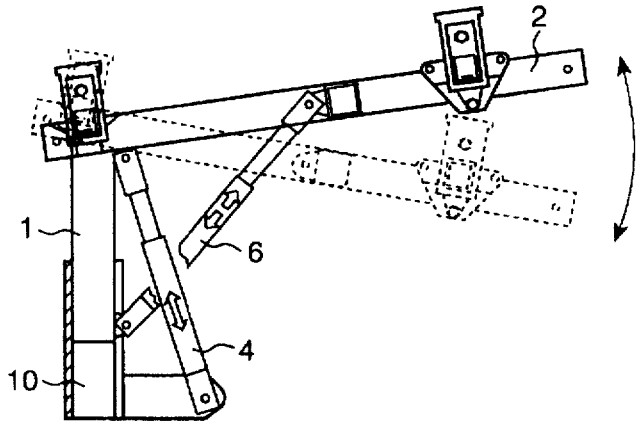
FIG. 2 shows the device according to FIG. 1 while the straightening bench is in different angles of gradient.
Figure 3:
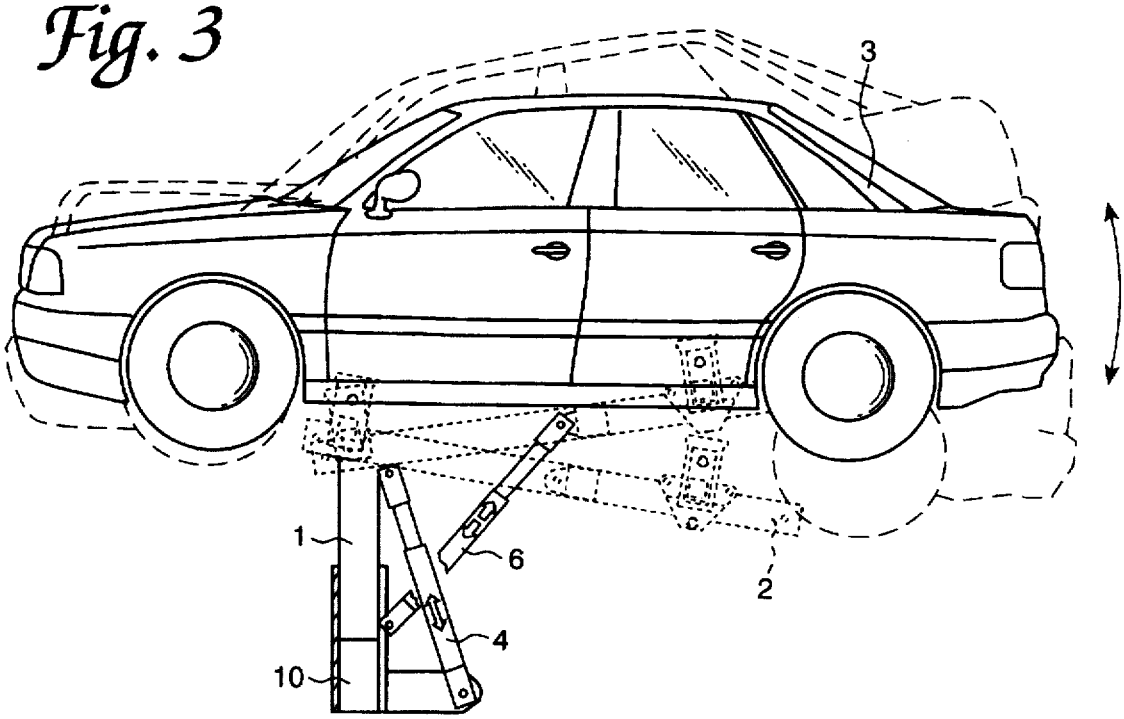
FIG. 3 shows the device according to FIGS. 1 and 2 while the car is mounted on the straightening bench and the straightening bench is in different positions.

The car body straightening system presented in FIGS. 1 to 4 includes a frame pipe 10, a support 1 which is an innerpipe and partly placed in the frame pipe having a construction allowing movement heightwise, a straightening bench 2 attached to one end of the support having a construction allowing the cylinder end to rotate and a cylinder 4 attached to the frame pipe and the straightening bench or to the inner pipe. Additionally, the straightening system includes a cylinder 6, which is at one end 5 pivotally attached to the straightening bench 2 and at the other end 7 pivotally attached to the support 1. There is a vertical groove made in the frame pipe which enables the cylinder 6 to move with the inner pipe 1 following its height. The cylinders 4 and 6 are hydraulic cylinders.

The straightening bench in different positions is presented in the figures; according to the FIG. 1 the straightening bench can be adjusted to the desired height with the help of the cylinder 4. According to the FIG. 2 the straightening bench 2 can be inclined with the help of the cylinder 6 in a desired way either upwards or downwards in order to adjust the position of the car in relation to the car body straightening system. This is illustrated also in the FIG. 3, where the car 3 is mounted on the straightening bench.

Figure 4:
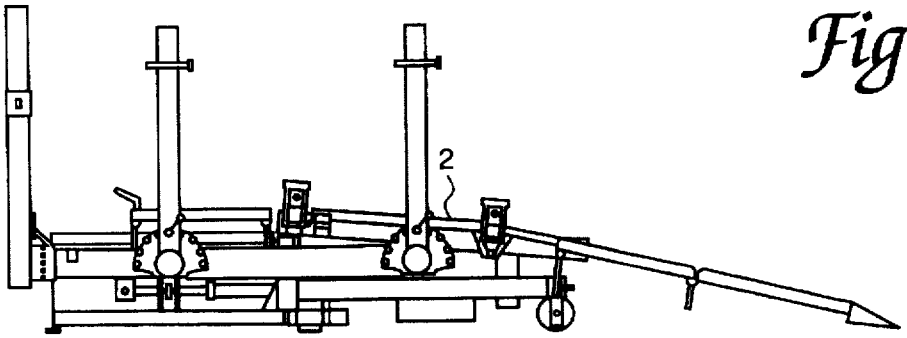
FIG. 4 to 7 show the straightening system where the device according to the invention has been used.
Figure 5:
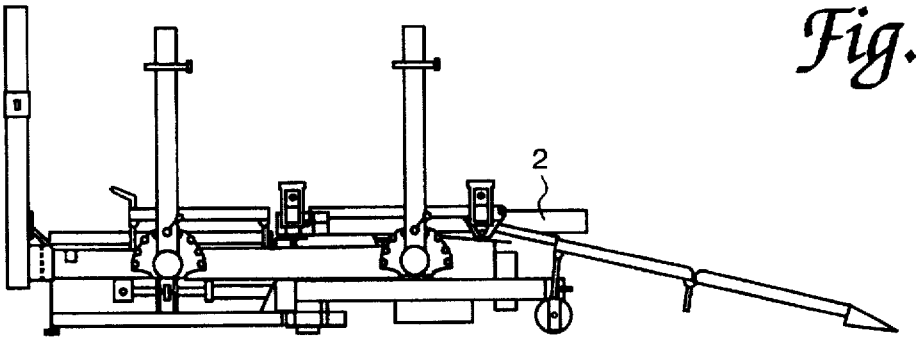
Figure 6:
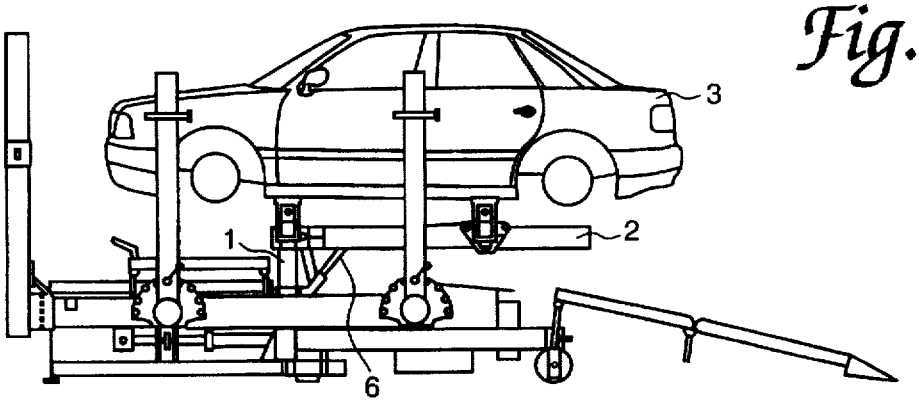
Figure 7:
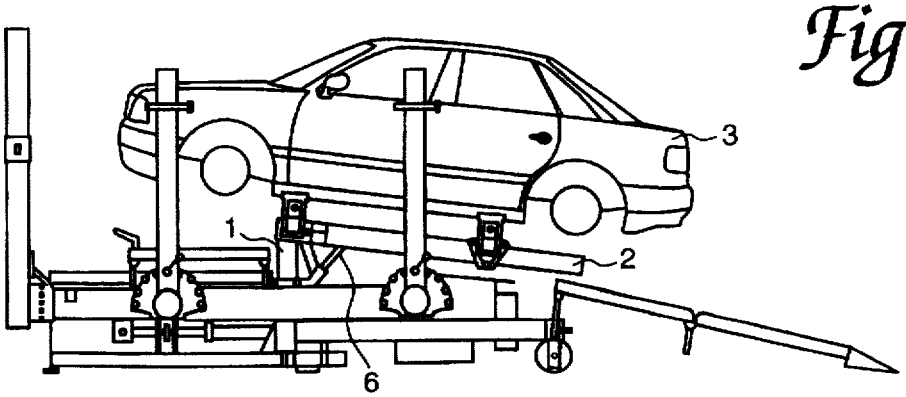

A straightening system including the device according to the invention is presented in the FIGS. 4 to 7. The FIG. 4 presents the straightening system where the straightening bench 2 has been inclined in the direction of the car ramp. A straightening bench 2 turned into the horizontal position is presented in the FIG. 5. A straightening bench 2 lifted to the work position is presented in the FIG. 6 and the FIG. 7 presents both a straightening bench 2 and a vehicle 3 inclined backwards.

Figure 8:
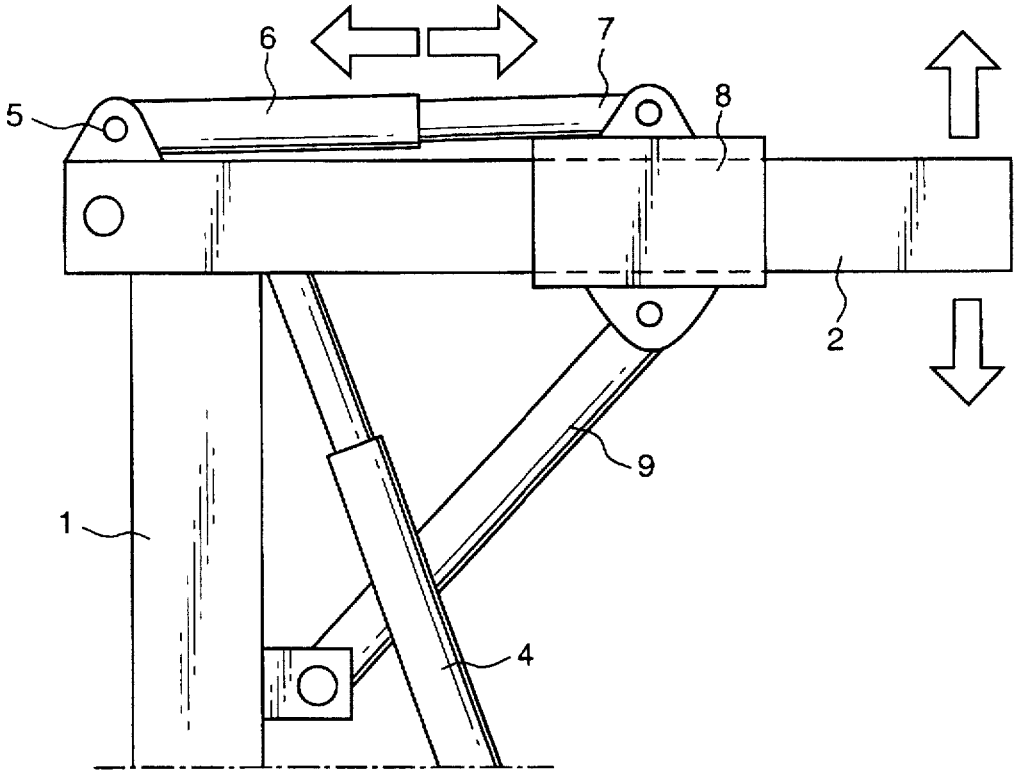
FIG. 8 presents another embodiment of the device according to the invention attached to the straightening bench.

In the adaption according to the FIG. 8 one end 7 of the cylinder 6 is attached to the slider 8. The slider is placed on the straightening bench and can be translated along its length. The other end 5 of the cylinder 6 is attached to the straightening bench. Additionally the support arm 9 is attached to the slider 8 and to the support 1 so as to be capable of pivoting movement with respect thereto. The support is an inner pipe vertically placed in the frame pipe also in the adaption. By moving the hydraulic cylinder 6 it is possible to incline the straightening bench to two different angles so that the straightening bench 2 turns supported by the support arm 9 upwards or downwards.

The invention is not restricted to the advantageous embodiments but it may vary within the scope of the inventional idea formed by the claims.

I claim:

1. A car body straightening and measuring system comprising:

a generally vertical frame pipe;

a support structure partially received within said frame pipe and adapted to be movable with respect to said frame pipe;

a straightening bench constructed and arranged to operatively support a vehicle thereon, said straightening bench being attached to said support structure and being movable with said support structure with respect to said frame pipe so as to be height adjustable, said straightening bench being pivotally attached to said support structure so as to be movable with respect to said support structure between an inclination below a horizontal orientation and an inclination above a horizontal orientation;

a first cylinder attached at one end thereof to said frame pipe and at an opposite end thereof to said straightening bench, said first cylinder being constructed and arranged so as to be selectively actuatable to move said support structure and said straightening bench with respect to said frame pipe to vary the height of said straightening bench; and a second cylinder attached at one end thereof to said straightening bench and at an opposite end thereof to said support structure, said second cylinder being constructed and arranged so as to be selectively actuatable to vary the position of said straightening bench with respect to said support member between the inclination below the horizontal orientation and the inclination above the horizontal orientation, said second cylinder being movable with said support structure and said straightening bench with respect to said frame pipe when the height of said straightening bench is varied and wherein a vertical groove is formed in said frame pipe to accommodate said second cylinder to enable said second cylinder to move with said support structure when the height of said straightening bench is varied.

2. A car body straightening and measuring system comprising:

a generally vertical frame pipe;

a support structure partially received within said frame pipe and adapted to be movable with respect to said frame pipe;

a straightening bench constructed and arranged to operatively support a vehicle thereon, said straightening bench being attached to said support structure and being movable with said support structure with respect to said frame pipe so as to be height adjustable, said straightening bench being pivotally attached to said support structure so as to be movable with respect to said support structure between an inclination below a horizontal orientation and an inclination above a horizontal orientation;

a slider structure coupled with said straightening bench and constructed and arranged to be translatable with respect to said straightening bench in a lengthwise direction;

a support member pivotally attached at one end thereof to said support structure and pivotally attached at an opposite end thereof to said slider structure, said support member being constructed and arranged to cause the inclination of said straightening bench to change as said slider is translated in the lengthwise direction with respect to said straightening bench;

a first cylinder attached at one end thereof to said frame pipe and at an opposite end thereof to said straightening bench, said first cylinder being constructed and arranged so as to be selectively actuatable to move said support structure and said straightening bench with respect to said frame pipe to vary the height of said straightening bench; and a second cylinder attached at one end thereof to said straightening bench and at an opposite end thereof to said slider structure, said second cylinder being constructed and arranged so as to be selectively actuatable to cause said slider to translate in the lengthwise direction with respect to said straightening bench and thus to vary the position of said straightening bench with respect to said support member between the inclination below the horizontal orientation and the inclination above the horizontal orientation, said second cylinder and said support member being movable with said straightening bench with respect to said frame pipe when the height of said straightening bench is varied.

* * * * *